US007841676B2

(12) United States Patent
Hawkins

(10) Patent No.: US 7,841,676 B2
(45) Date of Patent: Nov. 30, 2010

(54) MODULAR MERCHANDISING DISPLAY SYSTEM

(75) Inventor: David L. Hawkins, Akron, OH (US)

(73) Assignee: David L. Hawkins Design Management, Inc., Akron, OH (US)

( * ) Notice: Subject to any disclaimer, the term of this patent is extended or adjusted under 35 U.S.C. 154(b) by 743 days.

(21) Appl. No.: 11/626,988

(22) Filed: Jan. 25, 2007

(65) Prior Publication Data

US 2008/0042530 A1 Feb. 21, 2008

Related U.S. Application Data

(60) Provisional application No. 60/822,586, filed on Aug. 16, 2006.

(51) Int. Cl.
*A47B 77/00* (2006.01)

(52) U.S. Cl. ..... 312/107; 312/321.5; 312/199; 312/223.5

(58) Field of Classification Search ..... 312/321.5, 312/198, 199, 202, 324, 223.5, 107, 295
See application file for complete search history.

(56) References Cited

U.S. PATENT DOCUMENTS 2,808,610 A * 10/1957 Minor ..... 312/321.5
3,282,634 A * 11/1966 Marcus ..... 312/199
3,980,361 A * 9/1976 Shaw et al. ..... 312/198
4,918,579 A * 4/1990 Bennett ..... 312/223.5
5,622,010 A * 4/1997 Weber ..... 52/36.4
5,769,516 A * 6/1998 Aguilera ..... 312/321.5
6,283,608 B1 * 9/2001 Straat ..... 312/223.5
6,457,278 B1 * 10/2002 Fleming ..... 312/321.5
6,467,637 B2 * 10/2002 Riga ..... 211/94.01
6,616,109 B1 * 9/2003 Jarrett et al. ..... 312/321.5
6,634,727 B2 * 10/2003 Torres ..... 312/321.5
6,692,092 B1 * 2/2004 Evans ..... 312/311
6,926,136 B1 * 8/2005 Lynch-Bass ..... 312/321.5

FOREIGN PATENT DOCUMENTS

DE 3513000 * 10/1986 ..... 312/198

* cited by examiner

*Primary Examiner*—Hanh V Tran
(74) *Attorney, Agent, or Firm*—Hahn Loeser & Parks LLP; Jason R. Strobel

(57) ABSTRACT

A merchandising display system has modular sections that have removable display pallets. Cabinet modules, spacer modules, fixed modules, and slat-wall modules assemble together in a multitude of various combinations to create different merchandising displays. Cabinets may include merchandising displays on the inside and outside of the cabinet. Removable display pallets facilitate stocking and reconfiguring product displays. Fiber-optic lighting illuminates the pallets.

16 Claims, 11 Drawing Sheets

MODULAR MERCHANDISING DISPLAY SYSTEM

CROSS REFERENCE TO RELATED APPLICATION

This application claims the benefit of U.S. Provisional Application No. 60/822,586 filed on Aug. 16, 2006.

TECHNICAL FIELD

This invention relates to a display system, and more specifically to a merchandising display system having modular sections comprising display pallets.

BACKGROUND

Retail merchandising often involves displaying products on racks, shelves, or other merchandisers. Consumers who view the display of products can better appreciate the selection and features of the products available from a retailer. For some products, such as household fixtures such as faucets, or electronic devices such as cameras and mobile phones, or other products such as footwear, consumers prefer to interact with the products outside of the package. For this reason, some retailers display certain products without packaging, while maintaining packaged inventory separately.

Efficient use of space is important for a retailer. However, one problem retailers face when displaying products for consumers to interact with is the space efficiency of the display. For the consumer to interact with the products, the products are frequently positioned in a prime shelf space, and arranged with a low density on the shelves so the products are not crowded and confusing to the consumer. Some current product displays are inefficient in how they use floor space. Another problem with some current product display systems is that they are not readily re-configurable to new product arrangements. Further, in some stores featuring higher priced goods, consumers prefer an elegant, lighted display that is uncluttered and easy to interact with.

There remains a need in the art for a merchandising display system that overcomes one or more of these problems.

SUMMARY OF THE INVENTION

The present invention overcomes at least one disadvantage of the prior art by providing a merchandising display system comprising a first module comprising a cabinet having a front and a back; at least one door having a front door display, each door being moveable between a closed position and an opened position; and at least one auxiliary display, wherein the auxiliary displays are selected from the group consisting of an interior cabinet display and a rear door display; and a second module comprising a spacer display positioned adjacent to the cabinet and set back from the front of the cabinet; wherein the opened position of at least one of said doors occupies a space in front of the spacer display; and wherein the closed position of the at least one door at least partially covers the front of the cabinet.

DETAILED DESCRIPTION

Figure 1:
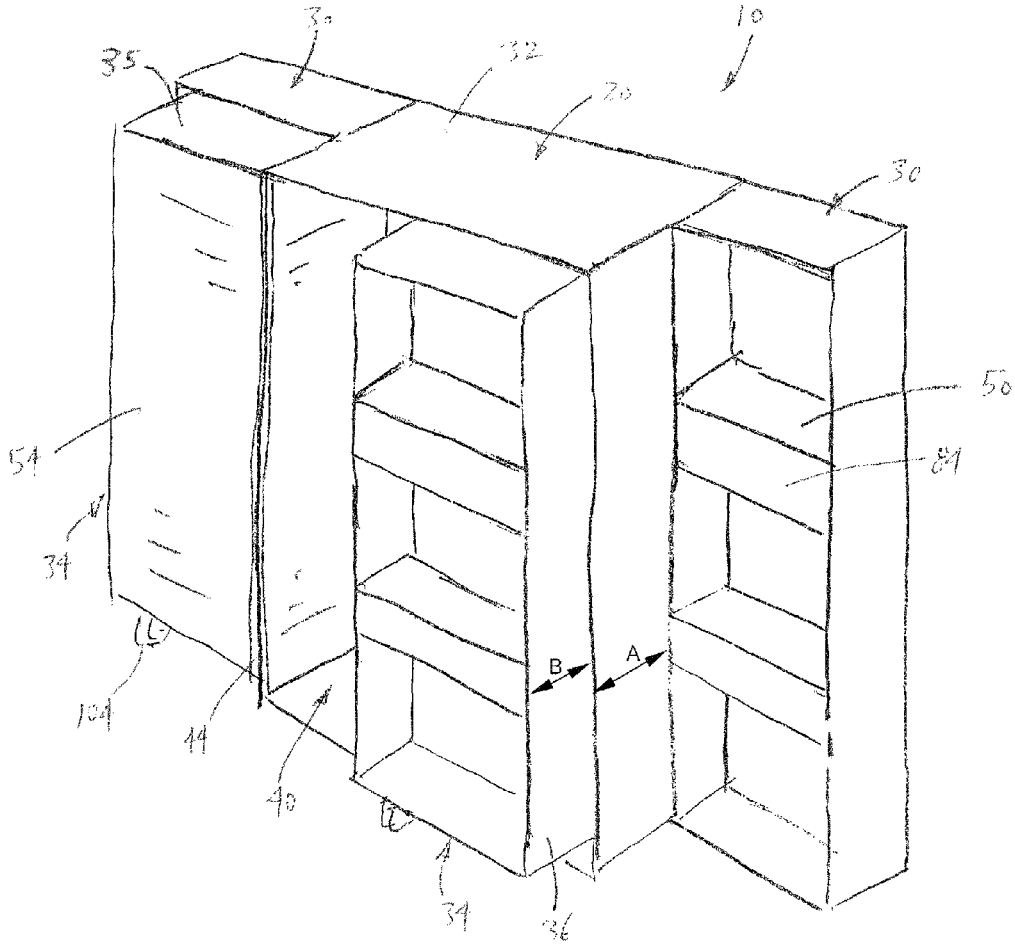
FIG. 1 is a front perspective view of one embodiment of a modular merchandising display system of the present invention.
Figure 2:
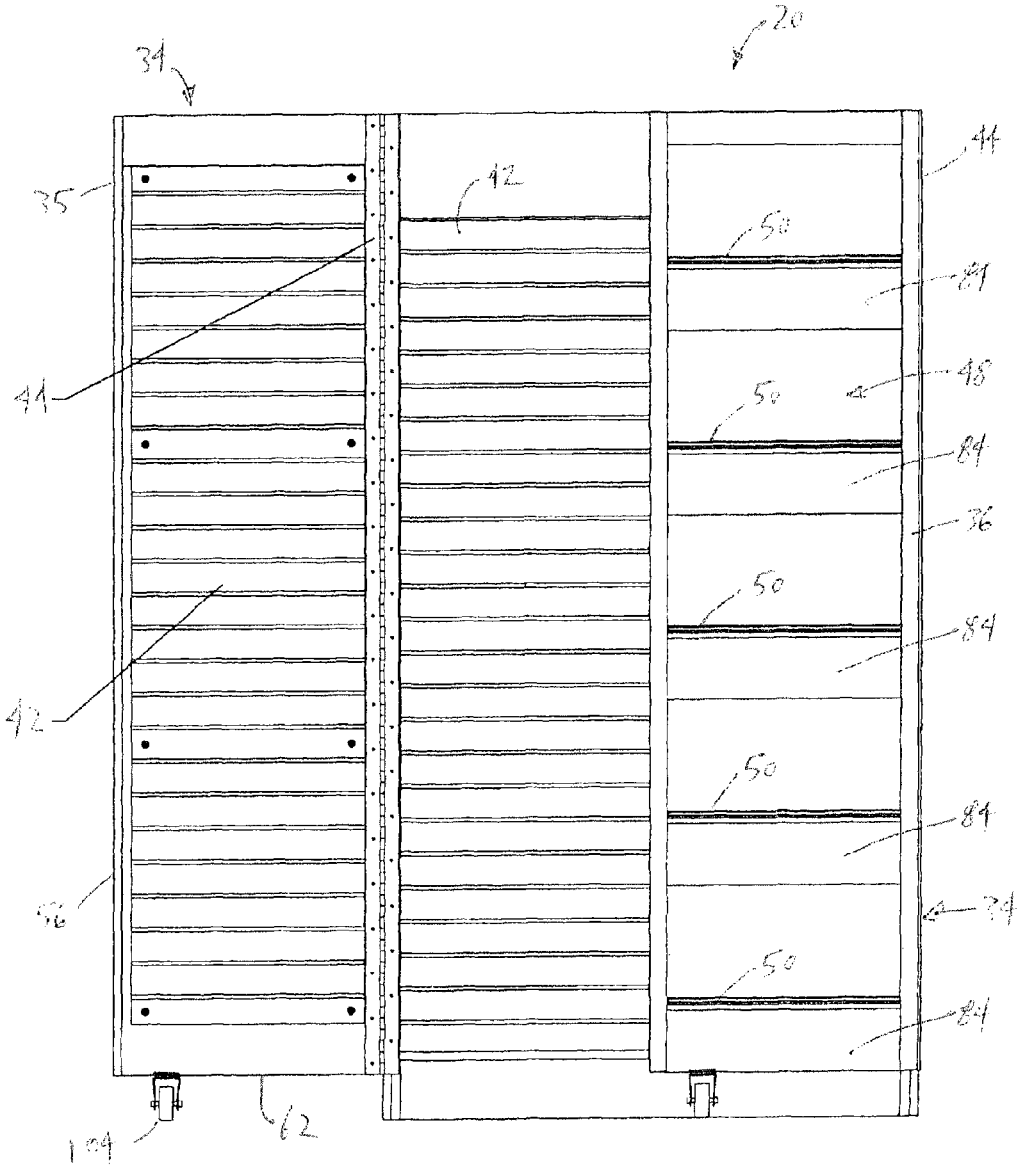
FIG. 2 is a front elevational view of a cabinet module of the present invention.
Figure 3:
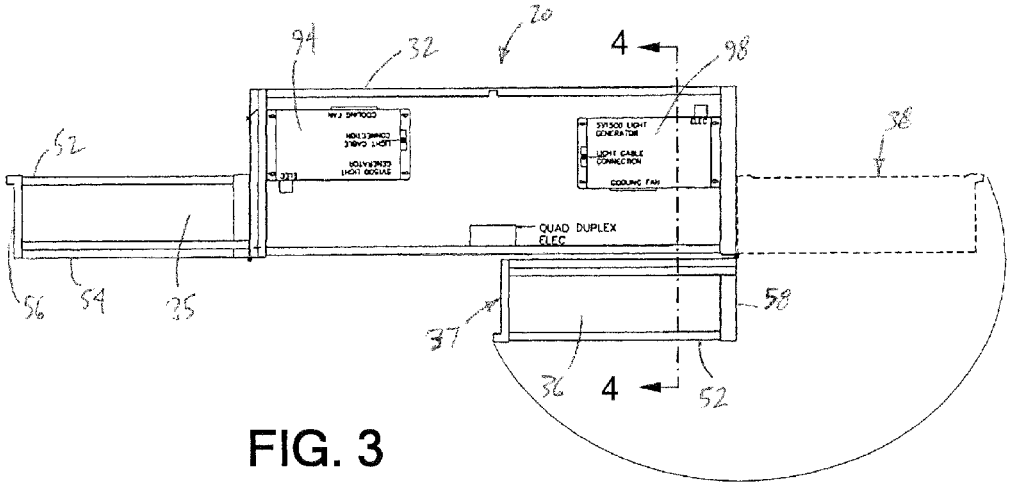
FIG. 3 is a top view of the cabinet module of FIG. 2.

Referring now to FIG. 1, one embodiment of a modular merchandising display system 10 is shown. FIG. 1 illustrates a merchandiser having one cabinet module 20 and two spacer modules 30. The cabinet module 20 as shown in FIGS. 1-4 comprises a cabinet 32 and two display doors 34, shown as a left door 35 and a right door 36. In other embodiments, the cabinet module may have one display door 34, or no display doors 34. The display doors 34 move from a closed position 37 to an opened position 38 to provide access to the cabinet interior 40. The cabinet interior 40 may comprise an interior cabinet display for merchandising products. Alternately, cabinet interior 40 may comprise a storage area for product inventory. In the embodiment of FIG. 2, the cabinet interior 40 has an interior cabinet display comprising slat wall paneling 42. Slat wall paneling 42 is well known in the art, exemplified by U.S. Pat. No. 3,235,218 to Graham, and U.S. Pat. No. 4,591,058 to Amstutz, et al. Hinges 44 rotatably attach the display doors 34 to the cabinet 32. In the embodiment of FIGS. 1-3, the doors 34 rotate approximately 180 degrees between the closed position 37 and the opened position 38.

Doors 34 include merchandising and display features. In the embodiment of FIGS. 1-4, doors 34 comprise at least one recessed cavity 48 comprising one or more pallets 50. In this embodiment, the doors 34 comprise a door front 52, a door back 54, a door first side 56 and a door hinge side 58, and a door top 60 and a door bottom 62.

The door front 52 may comprise a front door display, comprising one or more recessed cavities 48 and pallets 50. The door back 54 may comprise a rear door display including slat wall paneling 42 as illustrated in FIGS. 1-2. It is contemplated that the front door display and the rear door display may comprise one or more recessed cavities 48 and one or more pallets 50 alone or in combination with areas of slat wall paneling 42 and other merchandising attachments in various arrangements to accommodate different merchandising plans.

The spacer modules 30 are adjacent to the cabinet module 20. As illustrated in FIG. 1, the front of the spacer modules 30 is set back from the front of the cabinet to create a space for the doors 34 to open. In this embodiment, the front of the spacer modules is set back from the front of the cabinet 32 by a distance A, shown in FIG. 1. The thickness of the door is shown as distance B in FIG. 1. The distance A is greater than the distance B for the door 34 to open approximately 180 degrees.

Figure 8:
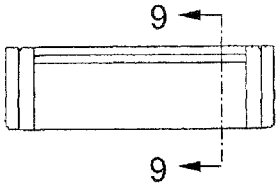
FIG. 8 is a top view of the spacer module of FIG. 7.
Figure 7:
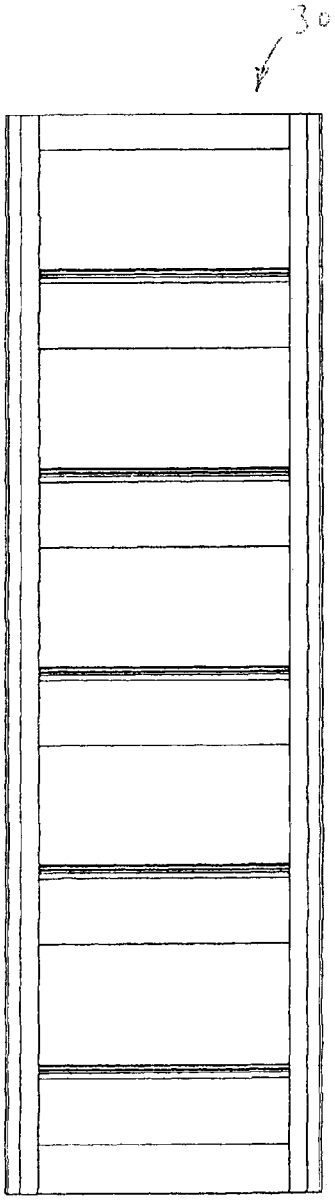
FIG. 7 is a front elevational view of a spacer module of the present invention.
Figure 9:
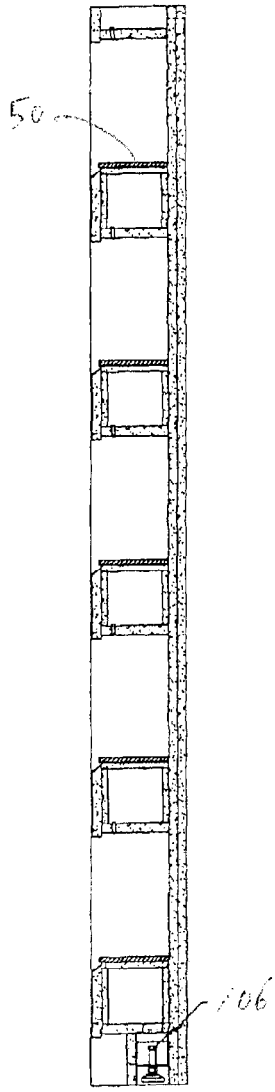
FIG. 9 is a cross sectional view through section 9-9 in FIG. 8.

One embodiment of the spacer module 30 is shown in FIGS. 7-9. In this embodiment, the spacer module 30 is wider than the door 34 so that the doors 34 may rotate open within the space in front of the spacer module 30. The spacer modules 30 may comprise at least one recessed cavity 48 comprising one or more pallets 50. It is contemplated that the spacer modules 30 may comprise slat wall paneling 42. In other embodiments, the spacer modules 30 may include one or more recessed cavities 48 comprising one or more pallets 50 in combination with areas of slat wall paneling 42 and other merchandising attachments in various arrangements.

Figure 11:
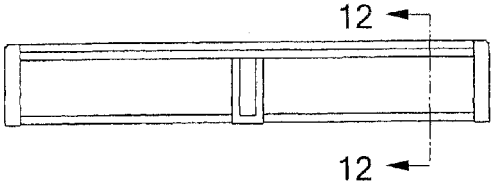
FIG. 11 is a top view of the fixed panel module of FIG. 10.
Figure 10:
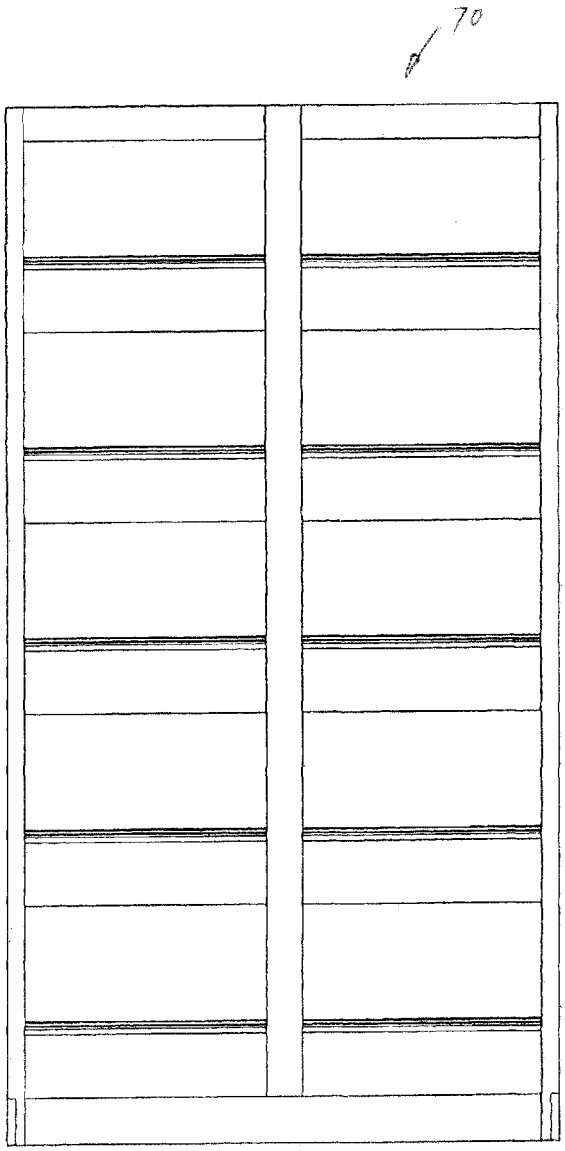
FIG. 10 is a front elevational view of a fixed panel module of the present invention.
Figure 12:
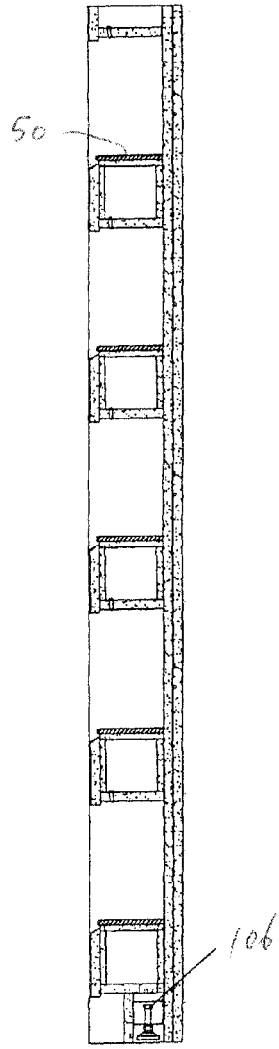
FIG. 12 is a cross sectional view through section 12-12 in FIG. 11.

Another module in the merchandising system is a fixed module 70. Fixed module 70 provides additional merchandising area. In the embodiment of FIGS. 10-12, the fixed module 70 may comprise at least one recessed cavity 48 comprising one or more pallets 50. It is contemplated that the fixed modules 70 may comprise slat wall paneling 42. In other embodiments, the fixed modules 70 may include one or more recessed cavities 48 comprising one or more pallets 50 in combination with areas of slat wall paneling 42 and/or other merchandising attachments in various arrangements.

Figure 13:
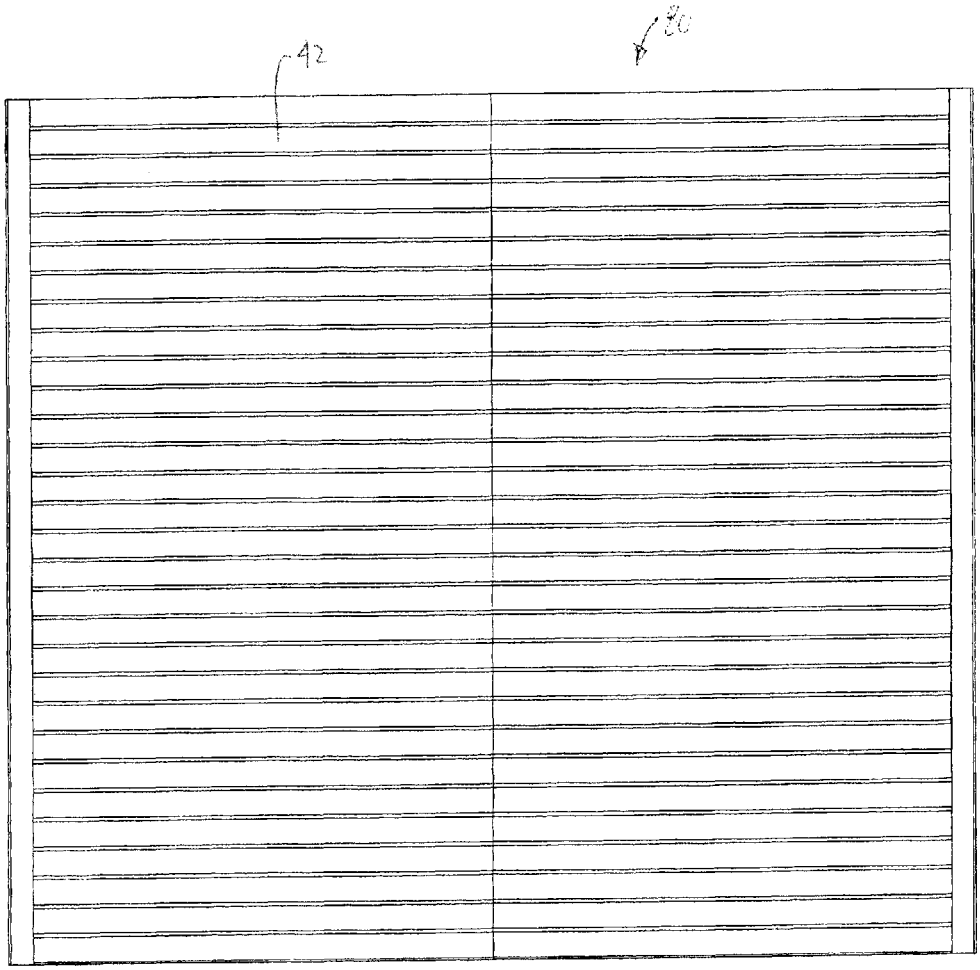
FIG. 13 is a front elevational view of a slat wall module of the present invention.

Yet another module in the merchandising system is a slat wall panel module 80, as illustrated in FIG. 13. The slat wall panel module 80 comprises slat wall paneling 42.

Figure 5:
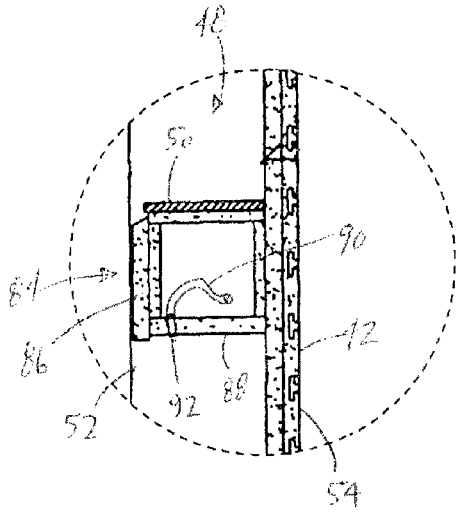
FIG. 5 is a partial view showing a section of a door of the cabinet module indicated by detail 5 in FIG. 4.

Referring now to FIG. 5, a pallet 50 may be positioned within the recessed cavity 48 on a pallet support 84. In this embodiment, pallet 50 may be a flat shelf and support 84 may comprise a hollow box-shaped cross-section. However, it is contemplated that the pallet 50 and corresponding support 84 may comprise other merchandising shapes and configurations. As defined here, the pallet 50 used in this specification and in the appended claims may comprise a bin, drawer, shelf, rack, rod, hanger, clip, a rotating, folding, or articulating merchandiser, or any unitary product-displaying merchandiser. The pallets 50 may comprise one or more apertures and protrusions for attaching a product to the pallets 50. The pallets 50 may also comprise one or more or apertures and protrusions to accommodate various merchandising requirements such as product nesting, orientation, or presentation.

The pallet support 84 holds the pallet 50 in its position on the display. In some embodiments, support 84 may comprise cross-sectional shapes other than a box section to accommodate the corresponding pallet 50 configurations. Pallet 50 and corresponding support 84 are used as defined here in the cabinet modules 20, the spacer modules 30, and the fixed modules 70.

The pallets 50 may be secured in place by fasteners, latches, or other physical restraints. It is also contemplated that the pallets 50 be removable. In removable embodiments, the pallets 50 may be unsecured, or may be secured by one or more releasable fasteners such as latches, hooks, or other releasable closures. Having removable pallets 50 may simplify restocking the products, or reconfiguring the merchandising arrangement. Further, in some displays the pallet 50 may be configured for the consumer to remove the pallet for easier product inspection or selection.

Figure 17:
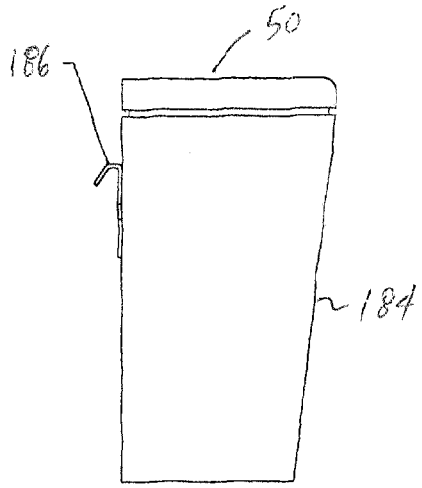
FIG. 17 is a side elevational view of an alternate embodiment of a pallet support of the present invention.
Figure 18:
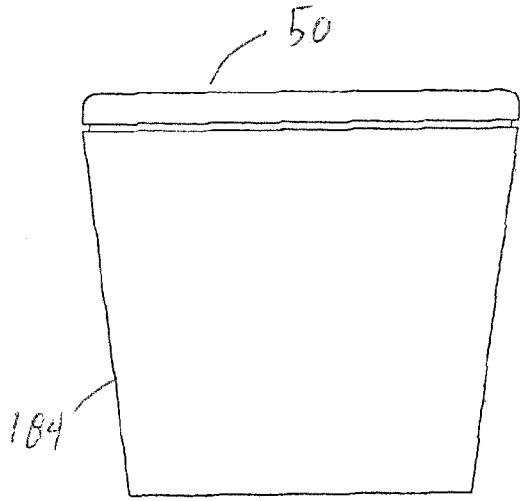
FIG. 18 is a front elevational view of the pallet support of FIG. 17.

In an alternate embodiment, pallets 50 are merchandised on the slat wall paneling 42 by adapting the corresponding support 84 to hang from the slat wall paneling 42. In FIGS. 17-18, the pallet 50 is supported by pallet support 184. The support 184 comprises bracket 186, where bracket 186 has a shape suitable for engaging the slat wall panel 42.

In some embodiments of the merchandising system 10, supports 84 may comprise means for lighting that is positioned for illuminating adjacent products. Means for lighting may comprise a fiber-optic lighting system, or may comprise a fluorescent, incandescent, light emitting diode, inert gas lighting, or other lighting system.

In the embodiment of FIG. 5, the support 84 comprises a support front 86 and a support bottom 88. This embodiment of support 84 comprises a hollow section, through which passes one or more optical fiber cables 90. An optical fiber cable 90 passes through an aperture 92 to illuminate the product below. In other embodiments, support bottom 88 may be transparent or translucent, and the optical fiber cables 90 direct light through support bottom 88. It is contemplated that support 84 may house an incandescent or fluorescent light bulb. It is also contemplated that the support 84 may not include the support bottom 88 to accommodate physical or lighting constraints.

The optical fiber cables 90 extend from each aperture 92 to a light generator 94. The light generator 94 may be installed on the top of the cabinet 32, as shown in FIG. 3. It is contemplated that the light generator 94 could be located in any convenient position within the merchandising system. The optical fiber cables 90 may be concealed behind a panel or in a raceway along an edge of the modules.

Figure 4:
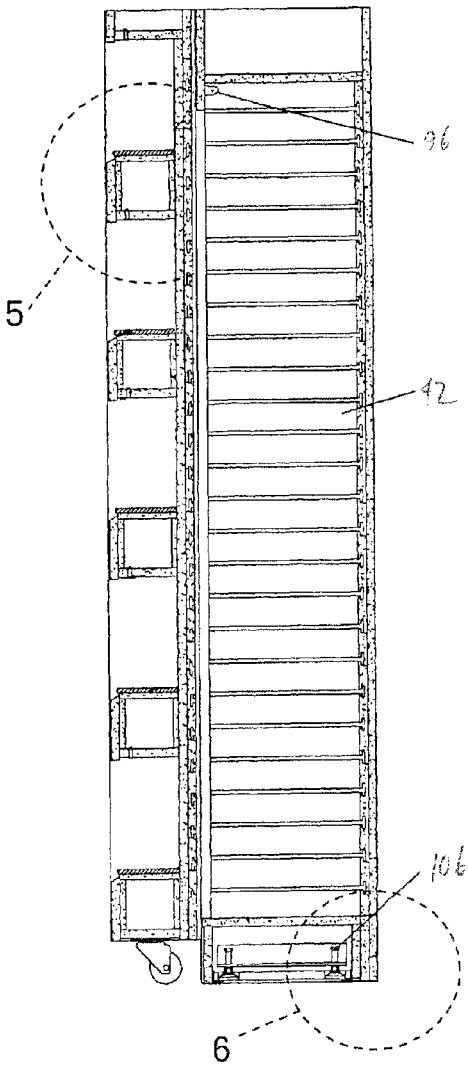
FIG. 4 is a cross sectional view through section 4-4 in FIG. 3.

As indicated in FIG. 4, a door switch 96 may be used to activate and de-activate the means for lighting. When the doors 34 are closed, the means for lighting that illuminates the inside of the cabinet 32 may be turned off to save electricity. In one embodiment, this is accomplished by using a second light generator 98 to illuminate the interior of the cabinet. In this embodiment, when door switch 96 closes, the second light generator 98 turns off, while light generator 94 continues to illuminate the exterior displays. It is contemplated that other controls may be employed to control the location, duration, and intensity of the lighting. Other lighting controls are well known in the art.

In the embodiment of FIG. 2, the hinges 44 are shown as piano-style hinges. In other embodiments, different hinge styles may be used. Alternately, the doors 34 may slide open into the space in front of the spacer module.

It is contemplated that the doors 34 may be heavy when loaded with products. In the embodiment of FIGS. 1-3, the doors 34 may include wheels 104. The wheels 104 are affixed to the door bottom 62, and transfer a portion of the door weight to the floor. The wheels 104 make the cabinet module more stable when the unit is fully loaded.

Figure 6:
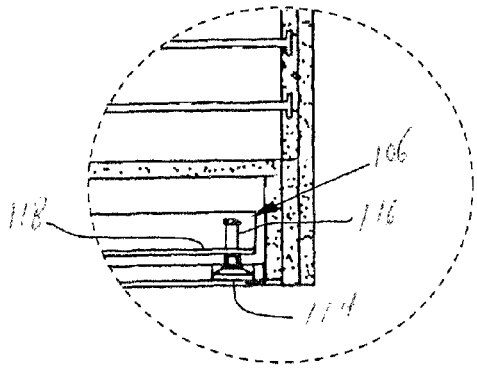
FIG. 6 is a partial view showing a leveler of the cabinet module indicated by detail 6 in FIG. 4.

The merchandising modules may include one or more levelers 106 so that the merchandising system can be level when installed on an uneven floor. The levelers 106 may be positioned on bottom corners of the cabinet 32, the spacer module 30, and the fixed module 70. It is contemplated that some modules may use four or more levelers 106, and some modules may use less than four levelers 106. In the embodiment of FIG. 6, the leveler 106 comprises a foot 114 connected to a threaded rod 116, where the threaded rod passes through a threaded hole in a fixed plate 118. Other mechanical levelers are known in the art.

Figure 14:
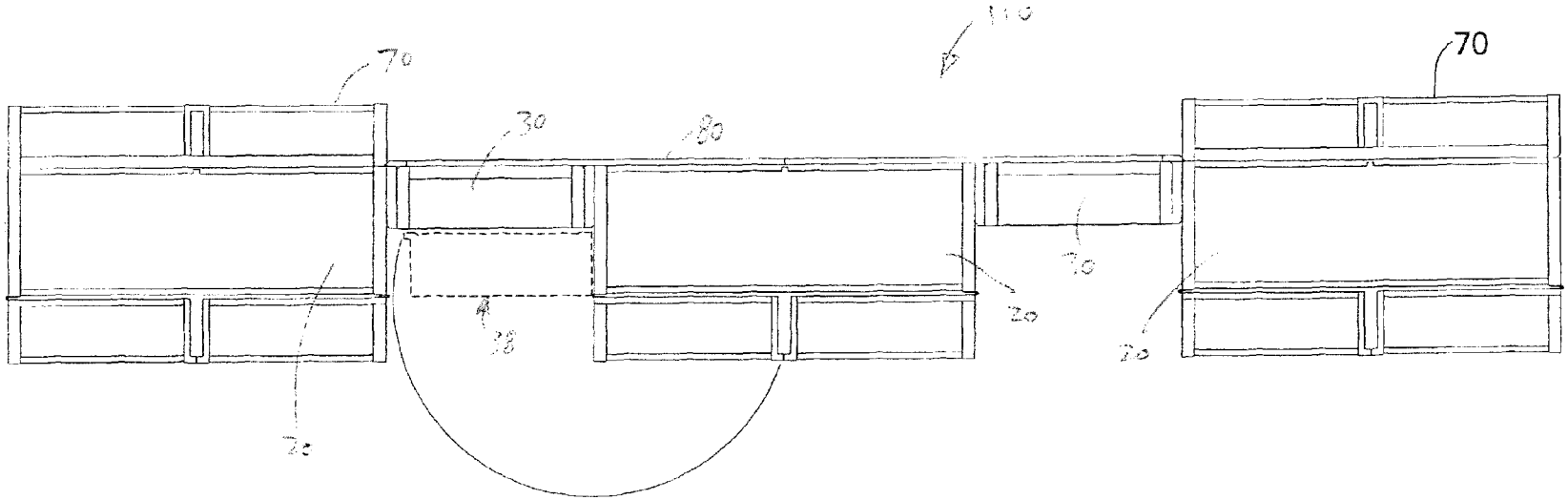
FIG. 14 is a top view of a second embodiment of a modular merchandising display system of the present invention.
Figure 15:
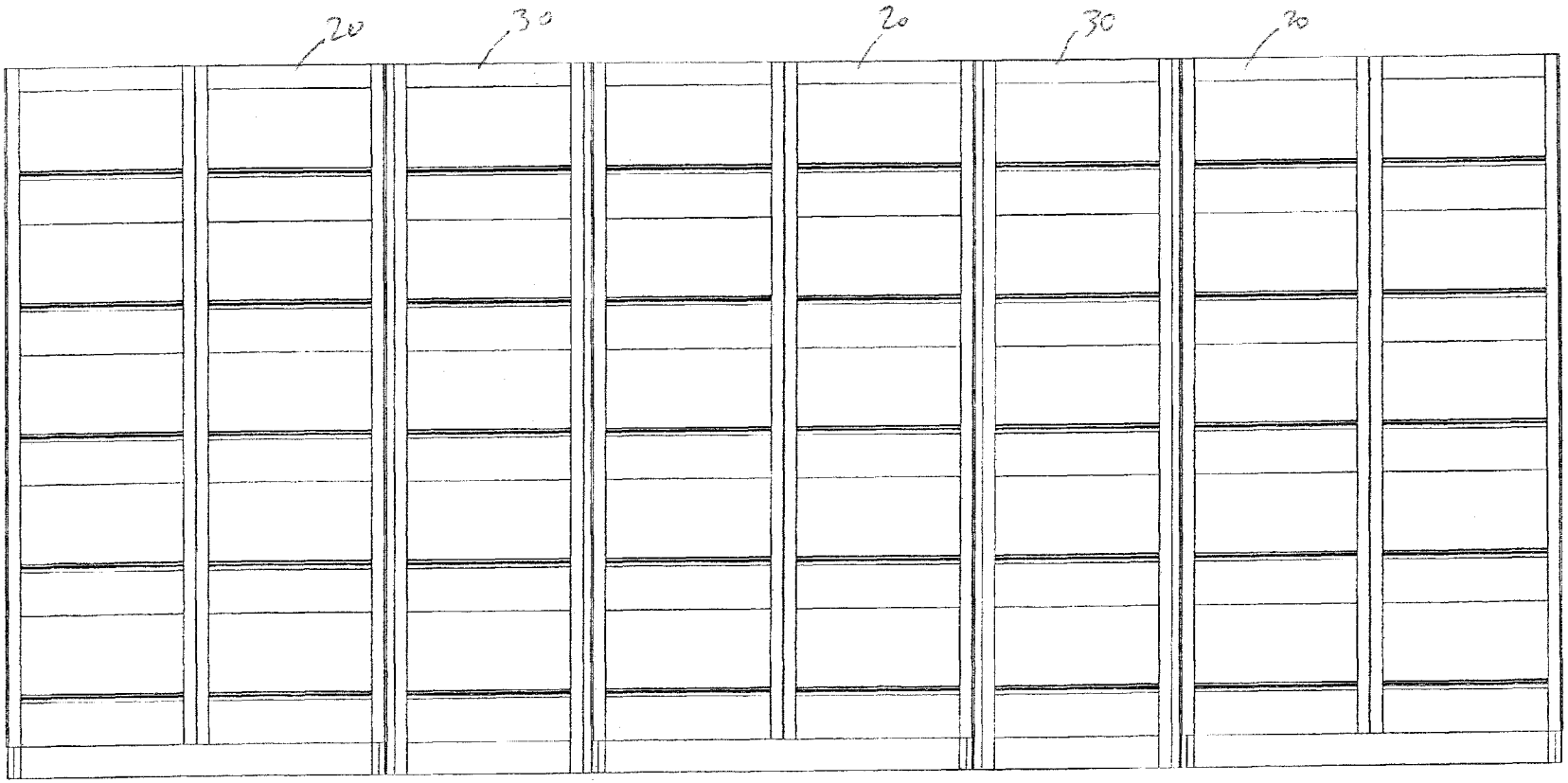
FIG. 15 is a front elevational view of the merchandising display system of FIG. 14.
Figure 16:
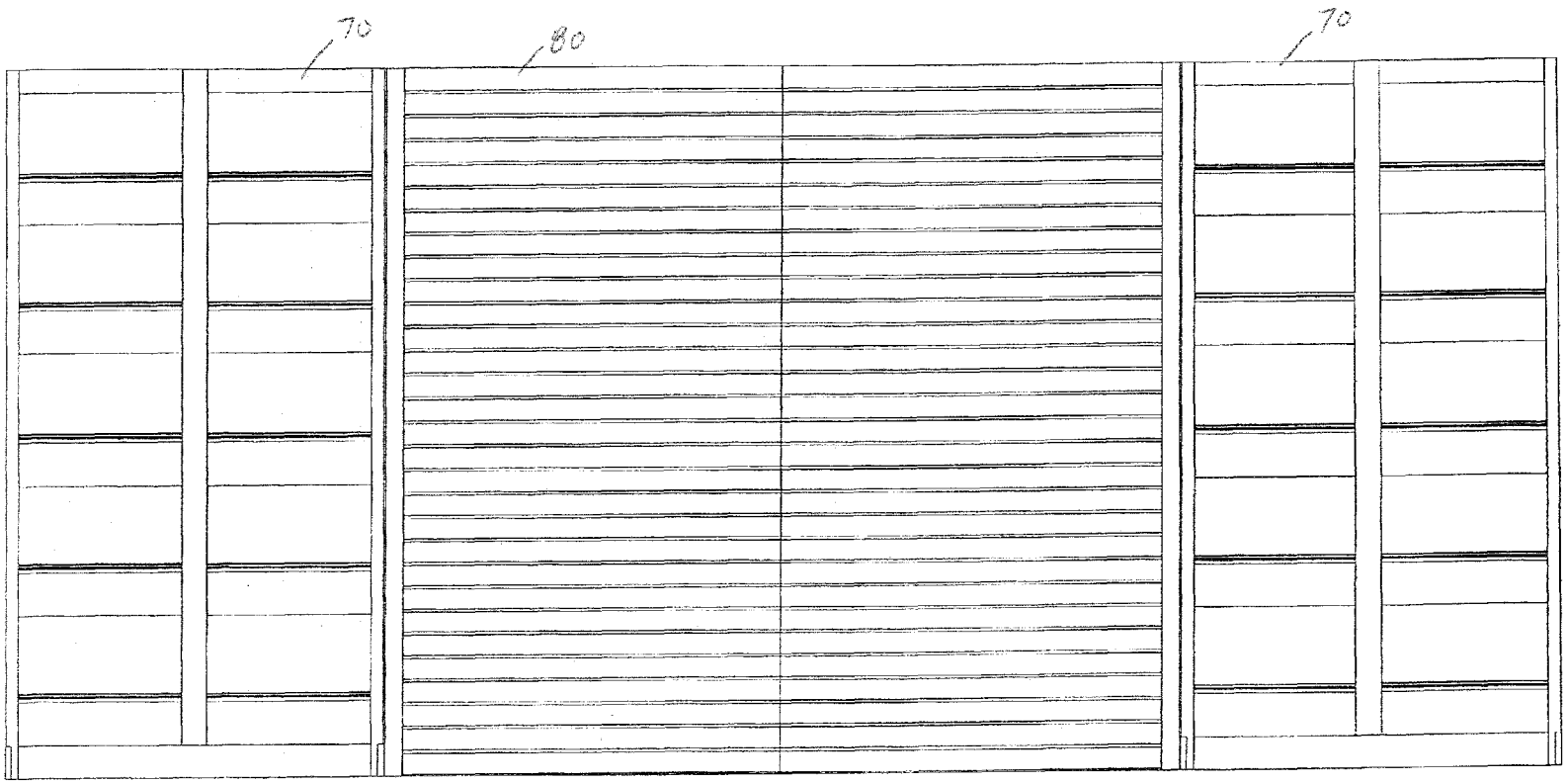
FIG. 16 is a rear elevational view of the merchandising display system of FIG. 14.

Various merchandising configurations can be achieved by joining a plurality of cabinet modules 20 and spacer modules 30, with one or more spacer modules 30 separating each pair of cabinet modules 20. Fixed modules 70 and slat wall panel modules 80 may be integrated, as shown by modular merchandising display system 110 in FIGS. 14-16. Alternately, one or more fixed modules 70 and slat wall panel modules 80 may be positioned between cabinet modules 20, or adjacent to one or more cabinet modules 20. It will be apparent to one skilled in the art that a multitude of combinations are available by varying the module selection and arrangement. It is contemplated that some assembled modular merchandising displays will only face one direction, suitable for placement against a wall or other fixture. The embodiment of FIG. 1 comprises modules that face in one direction. Other assembled modular merchandising displays may comprise elements facing two or more directions, suitable for placement where consumers can walk around the merchandiser. The embodiment of FIG. 14 comprises modules that face two directions.

Additional advantages and modifications will readily occur to those skilled in the art. Accordingly, the invention in its broader aspects is not limited to the specific details and illustrative examples shown and described here. Many modifications may be made to the present invention as described without departing from the spirit and scope of the invention, which is defined by the terms of the appended claims.

What is claimed is:

1. A modular merchandising display system comprising:

a cabinet module having:

a front and a back;

at least one door having a front door display, the at least one door being moveable between a closed position and an opened position; and, at least one auxiliary display selected from the group consisting of an interior cabinet display and a rear door display; and a spacer module positioned adjacent to the cabinet module and set back from the front of the cabinet module, wherein the door from the cabinet module occupies space in front of the spacer module when the door is in the open position;

wherein the at least one auxiliary display is presented when the at least one door is in the opened position, and wherein the at least one auxiliary display is at least partially concealed when the at least one door is in the closed position.

2. The modular merchandising display system of claim 1, wherein the door has a thickness; and the spacer module is set back from the front of the cabinet by a distance greater than the thickness of the door.

3. The modular merchandising display system of claim 1, wherein the door pivots approximately 180 degrees between the closed position and the opened position.

4. The modular merchandising display system of claim 1, wherein the front door display further comprises:

at least one pallet supported by at least one pallet support.

5. The modular merchandising display system of claim 4, wherein the pallet is removable from the pallet support and the front door display.

6. The modular merchandising display system of claim 1, further comprising:

means for lighting positioned to illuminate the front door display, the spacer display, and the at least one auxiliary display.

7. The modular merchandising display system of claim 5, wherein the means for lighting comprises at least one light source and a plurality of optical fiber cables.

8. The modular merchandising display system of claim 1, wherein the at least one auxiliary display comprises the interior cabinet display.

9. The modular merchandising display system of claim 1, wherein the at least one auxiliary display comprises the rear door display.

10. The modular merchandising display system of claim 1, wherein the auxiliary display comprises slat wall paneling.

11. The modular merchandising display system of claim 1, further comprising:

a third module comprising a fixed display comprising at least one pallet removably supported by at least one pallet support.

12. The modular merchandising display system of claim 11, further comprising:

means for lighting positioned to illuminate the fixed display.

13. The modular merchandising display system of claim 1, further comprising:

a fourth module comprising a slat wall panel.

14. A modular merchandising display system comprising:

a cabinet having a front;

at least one door having a front door display, the at least one door being moveable between a closed position and an opened position;

at least one auxiliary display, wherein the auxiliary display is selected from the group consisting of an interior cabinet display and a rear door display;

a spacer display adjacent to the cabinet; and means for lighting the front door display and the at least one auxiliary display, wherein the at least one auxiliary display is presented when the at least one door is in the opened position, wherein the at least one auxiliary display is at least partially concealed when the at least one door is in the closed position, wherein the spacer display is set back from the front of the cabinet; and wherein the opened position of the door is located in front of the spacer display approximately 180 degrees from the closed position.

15. The modular merchandising display system of claim 14, wherein the front door display further comprises:

at least one removable pallet supported by at least one pallet support.

16. The modular merchandising display system of claim 14, wherein the means for lighting comprises at least one light source and a plurality of optical fiber cables.

* * * * *